US012116717B2

(12) United States Patent
Lana

(10) Patent No.: US 12,116,717 B2
(45) Date of Patent: Oct. 15, 2024

(54) WETSUIT STORAGE AND DRYING APPARATUS

(71) Applicant: Claudio Lana, San Diego, CA (US)

(72) Inventor: Claudio Lana, San Diego, CA (US)

( * ) Notice: Subject to any disclaimer, the term of this patent is extended or adjusted under 35 U.S.C. 154(b) by 681 days.

(21) Appl. No.: 17/356,452

(22) Filed: Jun. 23, 2021

(65) Prior Publication Data

US 2021/0395938 A1 Dec. 23, 2021

Related U.S. Application Data

(60) Provisional application No. 63/043,102, filed on Jun. 23, 2020.

(51) Int. Cl.
*D06F 58/10* (2006.01)

(52) U.S. Cl.
CPC ..... *D06F 58/10* (2013.01)

(58) Field of Classification Search
CPC ..... D06F 58/10
USPC ..... 34/202
See application file for complete search history.

(56) References Cited

U.S. PATENT DOCUMENTS 4,997,000 A * 3/1991 Feast ..... D06F 18/00 134/115 R
5,713,137 A * 2/1998 Fujita ..... F26B 9/006 34/106
5,862,606 A * 1/1999 Jannach ..... D06F 41/00 34/106
6,516,536 B2 * 2/2003 Ryden ..... F26B 9/003 34/106
6,742,276 B1 * 6/2004 Anderson ..... D06F 34/26 34/106
7,320,347 B2 * 1/2008 Ramsey ..... B60P 7/065 141/285
7,984,567 B2 * 7/2011 Bertakis ..... A45D 44/14 34/100
8,793,892 B2 * 8/2014 McLoughlin ..... F26B 9/003 248/165
9,003,837 B2 * 4/2015 Cassidy ..... D06F 17/04 68/5 C
10,294,606 B2 * 5/2019 Prey ..... G01M 3/027
2013/0214015 A1 * 8/2013 Wood ..... E05B 69/006 223/85
2021/0395938 A1 * 12/2021 Lana ..... D06F 58/10

FOREIGN PATENT DOCUMENTS

GB 2394271 A * 4/2004 ..... D06F 58/10

* cited by examiner

*Primary Examiner* — Stephen M Gravini
(74) *Attorney, Agent, or Firm* — James Scott Nolan

(57) ABSTRACT

A wetsuit storage and drying apparatus includes a housing that defines an interior space, an opening that is closable by a door, the opening through which a wetsuit can be provided and retrieved, and one or more racks connected with an inner wall of the housing and on which a wetsuit can be draped. The apparatus further includes a dehumidifier for drawing moisture from a proximity of each wetsuit to condense the moisture and dispense with the condensation from the interior space, allowing each wetsuit to dry quicker and more efficiently than conventional techniques.

10 Claims, 6 Drawing Sheets

WETSUIT STORAGE AND DRYING APPARATUS

CROSS-REFERENCE

This application claims the benefit of U.S. Provisional Application No. 63/043,102, filed Jun. 23, 2020. This application is incorporated by reference in its entirety.

BACKGROUND

Wetsuits are used extensively in various water sports such as surfing, stand-up paddle boarding, swimming, snorkeling, scuba diving, swimming, and others. Wetsuits are a close-fitting and thermally-insulating garment, typically made out of a synthetic polymerized material such as neoprene or other rubber-like material. Unlike a "drysuit," wetsuits are not designed to exclude water. Water that does get into a wetsuit, either between the wearer's skin or absorbed into the material directly, especially where the material is an open-cell foam, cooperates with a wearer's skin to keep the wearer warm, and substantially insulated from cold outside water or air.

Most conventional wetsuits, particularly in the sport of surfing, are made of a foam material that absorbs water. Consequently, once a surfer is done with his or her surfing session, they will need to dry their wetsuit before donning it again. If a wetsuit is still wet or even slightly damp, it is much more difficult to put on, and very uncomfortable during the putting-on process, especially in cold weather.

Wetsuits are commonly dried by hanging or draping over a tube or rod and allowed to drip-dry. Given the tight cellular nature of the wetsuit material, however, such drying can take well over 24 hours, which is not conducive to being able to wear the wetsuit more than once per day. Further, such method of drying can allow water to drip or spill on a floor underneath and around a hanging wetsuit. The drying time can be accelerated, however, by placing a damp wetsuit into a clothes dryer, or in direct sunlight. Yet each of these methods to accelerate the drying process can lead to unnecessary stretching, brittleness, and separation of at least some of the seams of the wetsuit garment. In particular, ultraviolet light from sunlight can quickly degrade the material, causing it to become thinned out, brittle, and less effective as an insulator.

Given the aforementioned limitations of conventional and widely-used techniques for drying a wetsuit, what is needed is a system and method for drying a wetsuit, where the drying process can be reduced to just a few hours or less, and yet avoid the problems of sunlight or clothes-dryer drying.

SUMMARY

This document describes a wetsuit storage and drying apparatus and system that overcomes the limitations and problems described above. The apparatus and system enables the drying process to be significantly reduced in time, while avoiding the damaging effects of tumble drying and drying in direct sunlight.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
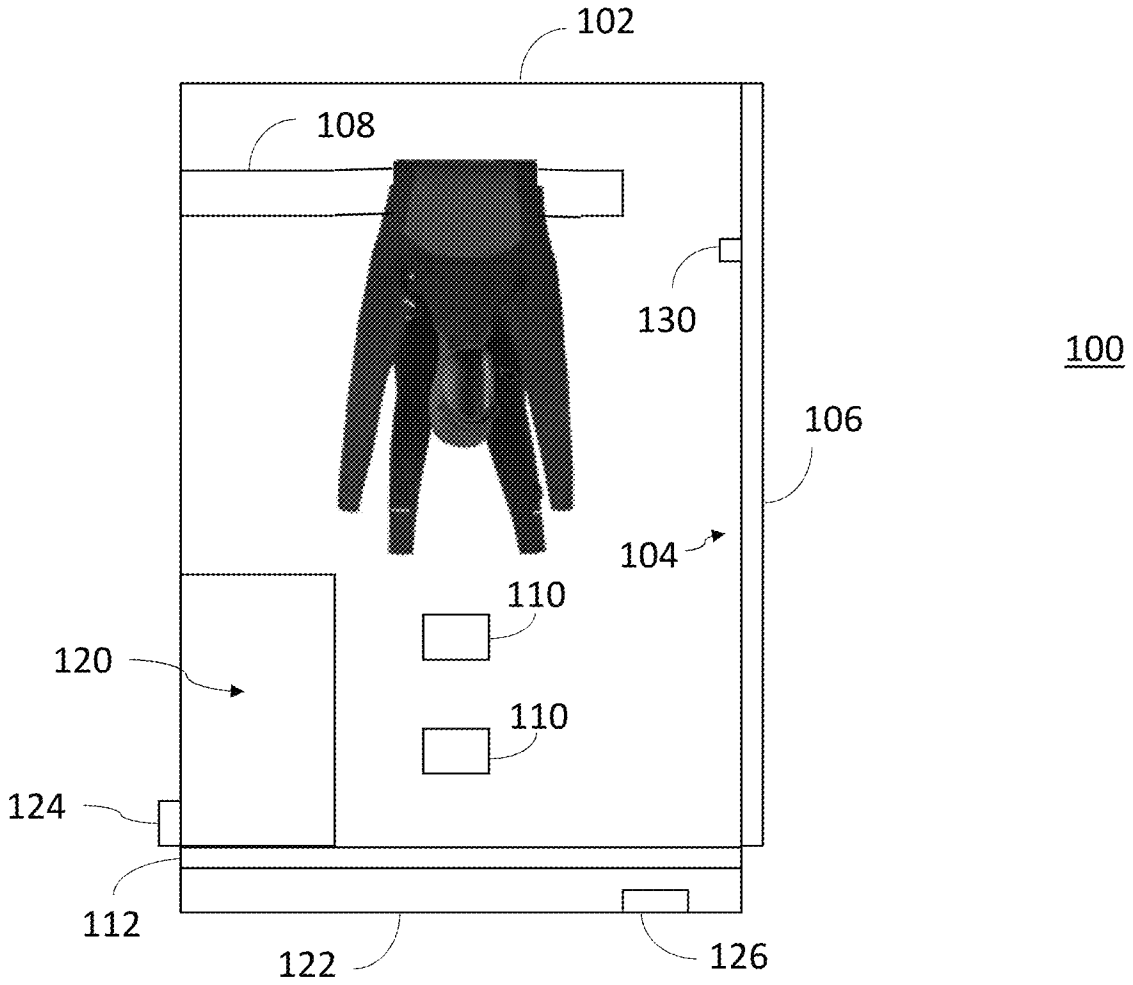
FIG. 1 shows a representation of a wetsuit storage and drying apparatus in accordance with implementations described herein.
Figure 2:
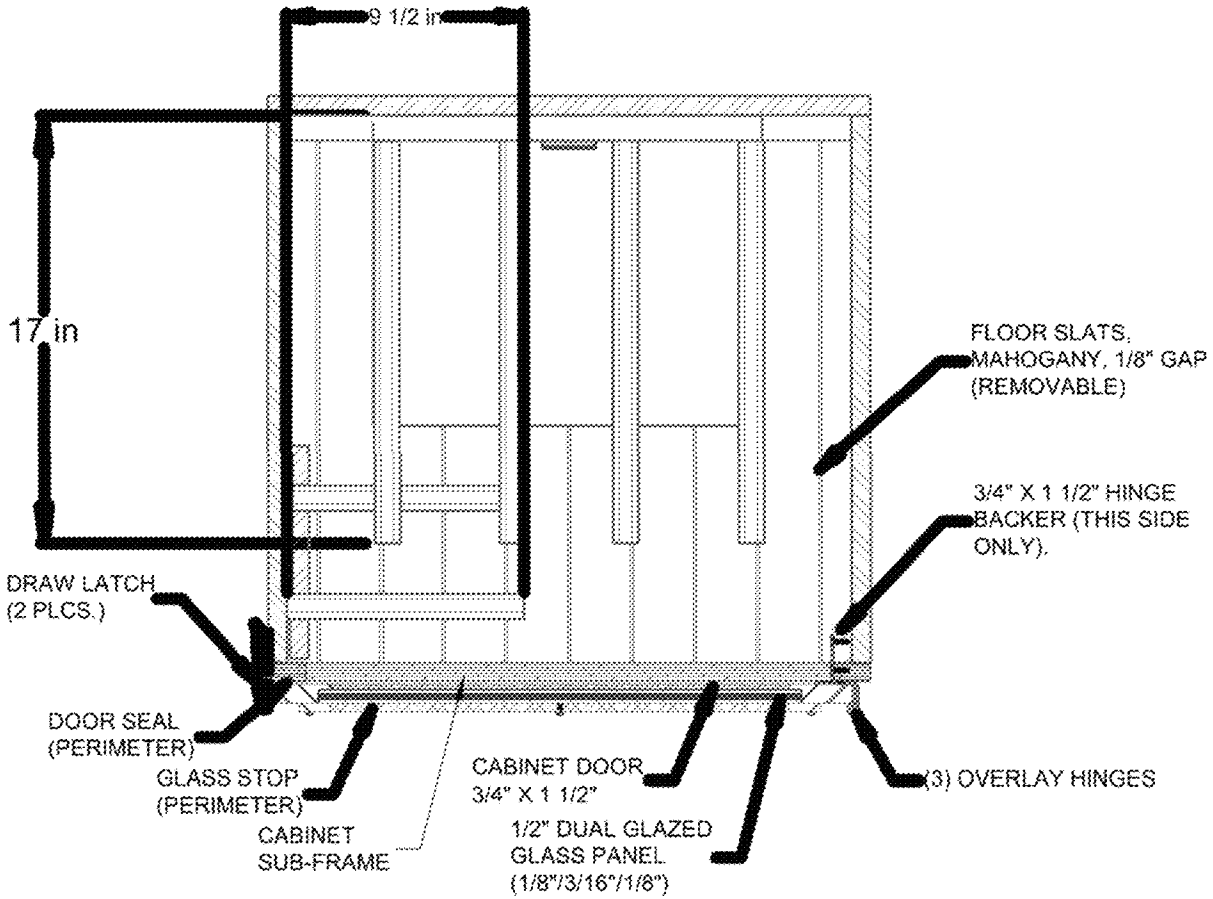
FIGS. 2-6 illustrate a specific design for a wetsuit storage and drying apparatus, in accordance with implementations described herein.
Figure 3:
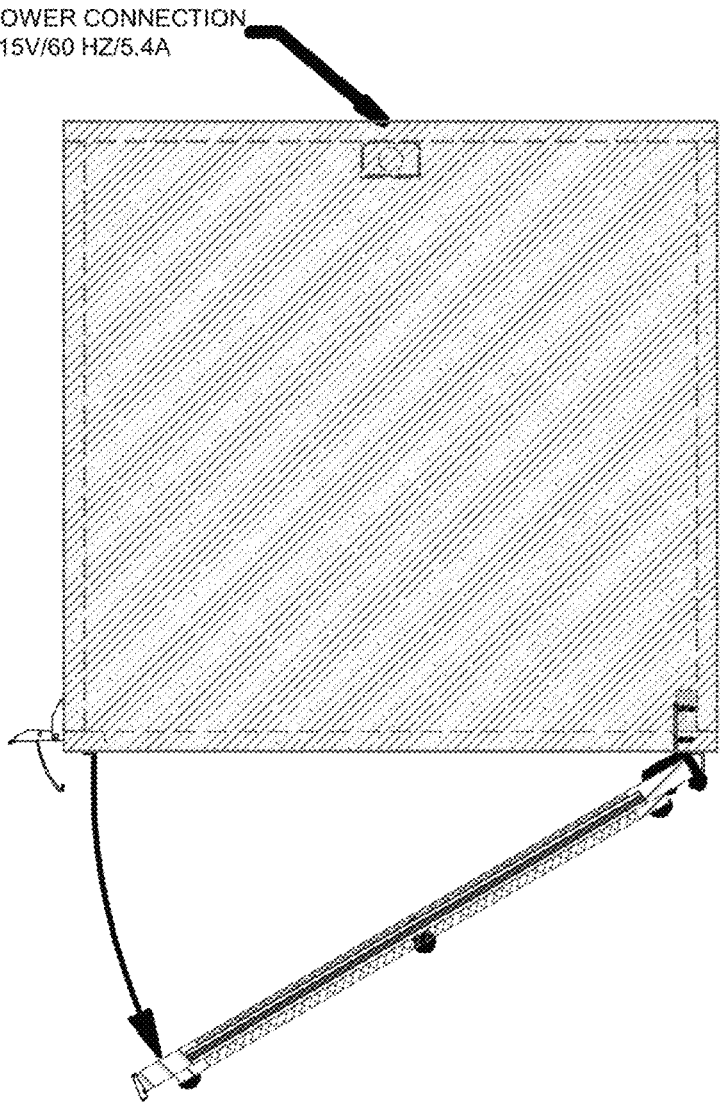
Figure 4:
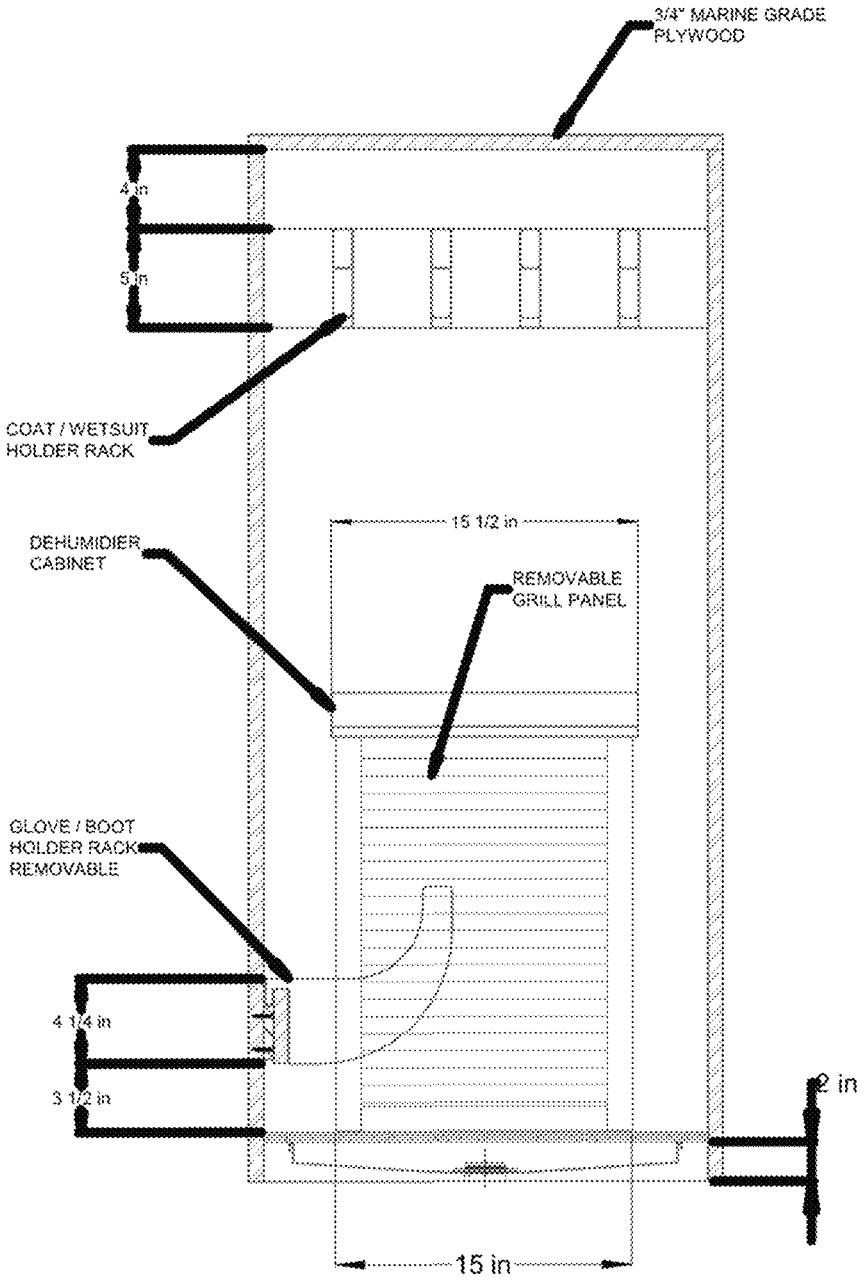
Figure 5:
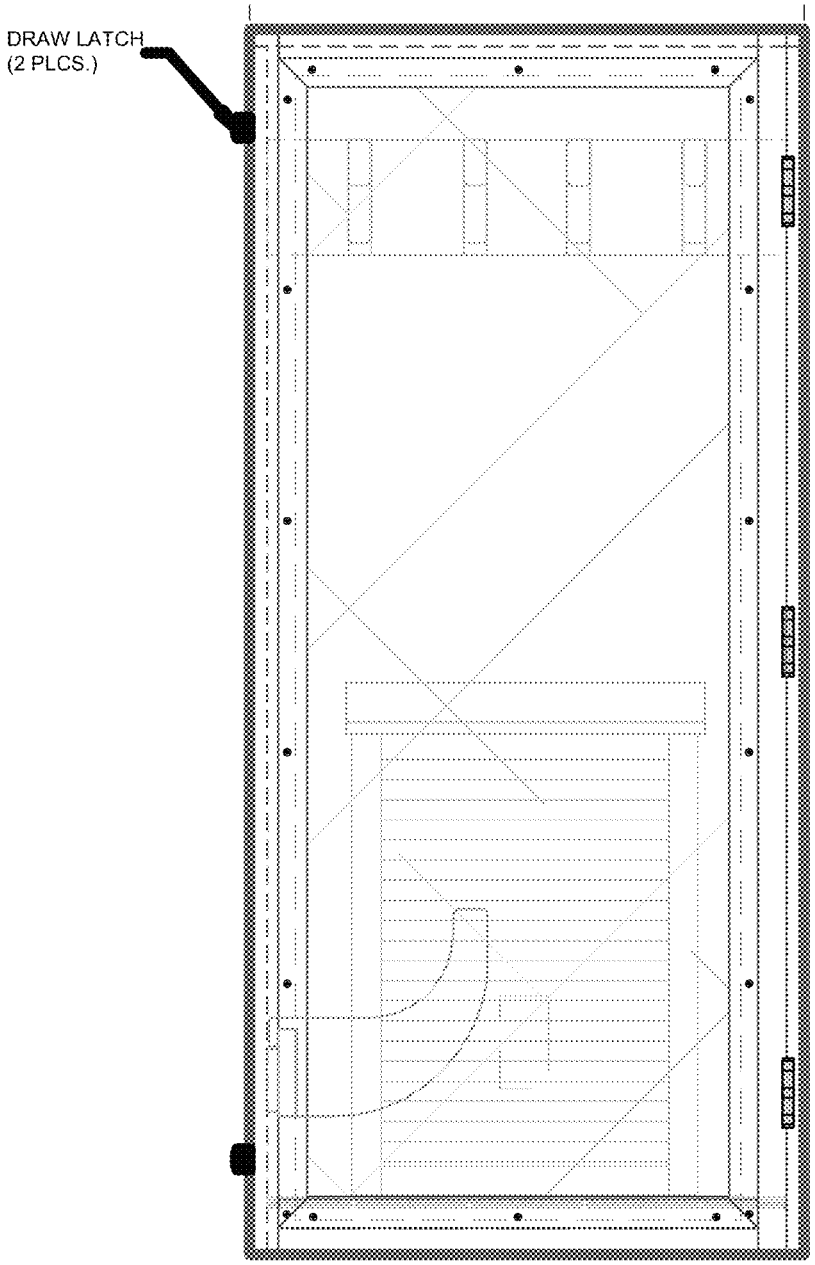
Figure 6:
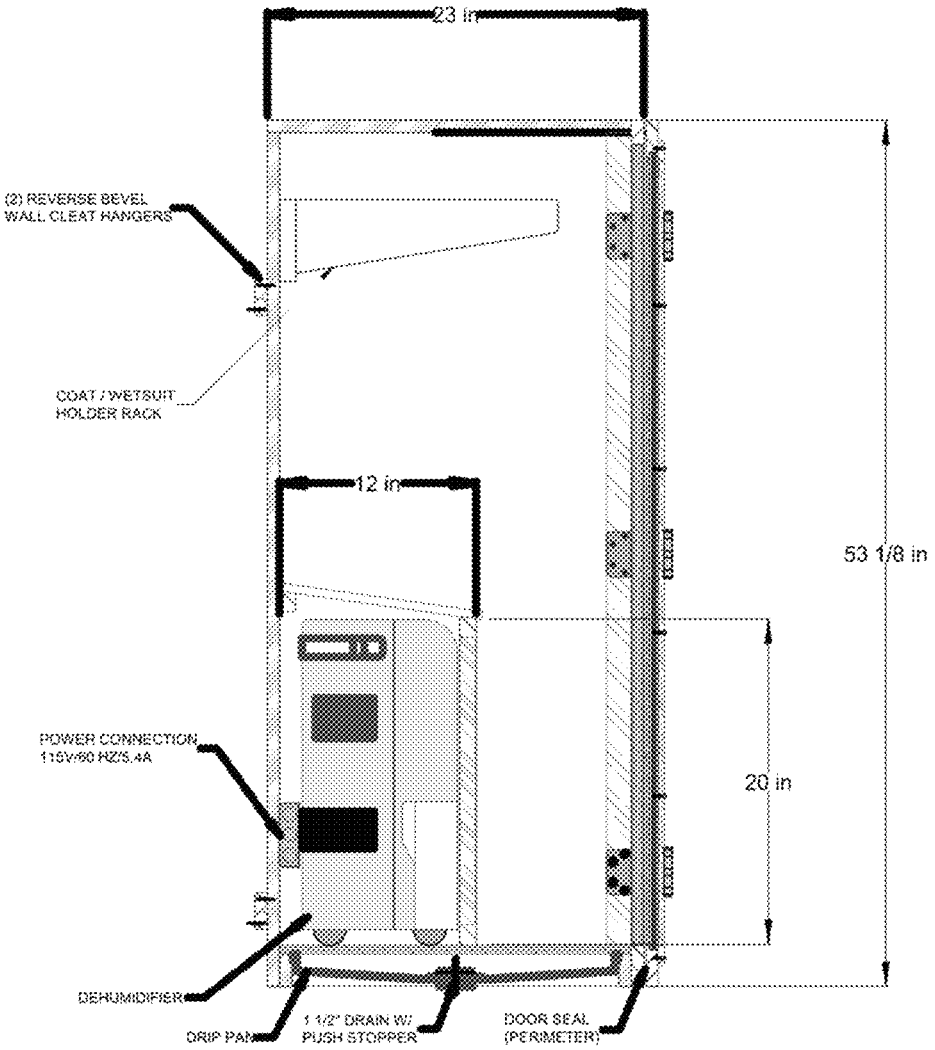

This document describes a wetsuit storage and drying apparatus. In preferred implementations, as depicted in FIG. 1, a wetsuit storage and drying apparatus 100 includes a housing 102. The housing 102 can be formed of any suitable rigid or semi-rigid material, such as wood, metal such as aluminum, plexiglass, or the like. In alternative implementations, the housing 102 can include a support structure, such as framing, that supports one or more walls of flexible materials. The support structure can be wood, metal, carbon fiber rods, nylon, plastic, or the like.

The housing 102 is configured to create an enclosure, with an interior space of 10-30 square feet, and preferably about 20 square feet (1.85 $m^3$). The interior space can be squared, rectangular, cylindrical, or rounded, such as having a flattened circular cross-section. The housing 102 includes closed sides and one opening 104. The opening 104 can be an entire front face of a cubed housing 102, or a front radial section of a cylindrical housing 102. The opening 104 includes a door 106 that allows ingress and egress of one or more wetsuits and other accessories, such as booties, gloves, caps, or the like. The door 106 can be a hinged door, with a seal or gasket on a perimeter of the door 106 or on a perimeter of the opening 104, or both. The door 106 can include a latch, connector, magnet, friction-fit, or other mechanism for maintaining the door 106 in a closed position once the one or more wetsuits are provided to the interior space of the housing 102. In some implementations, the door 106 can be made of the same material as the housing 102. However, in other implementations, the door 106 can include a frame and a window made out of glass, plexiglass, or some other transparent material, to allow a person to view the wetsuit inside.

The apparatus 100 further includes one or more racks 108 that preferably extend from an inner side wall of the housing 102. Each rack 108 is shaped and configured to allow a wetsuit to be draped over the rack 108, since a hanging of a wetsuit otherwise might stretch it too much in undesirable ways. As such, each rack 108 can have a rounded upper edge and flat opposing side surfaces, where the rounded upper edge can have a diameter of at least 6 inches to prevent creases in the wetsuit. In some implementations, the rack 108 can have one or more holes or passageways, to allow air flow therethrough. Each rack 108 can be attached to the inner side wall of the housing 102 in any number of ways, and a height or position of each rack 108 can be adjustable. For instance, each rack 108 can include one or more pins or hooks at a proximal end to connect with a corresponding hole or aperture in the inner side wall of the housing 102. Each rack 108 is configured to support a wetsuit when it is wet.

The apparatus 100 can further include one or more accessory racks 110, depicted in FIG. 1 as extending into the interior space of the housing 102 from another side wall of the housing 102. Each accessory rack 110 can be configured to hold an accessory made out of wetsuit material, such as a bootie, a glove, a head cap, or the like. The accessory racks 110, like the racks 108, can be positioned or placed anywhere within the interior space of the housing, and as such, corresponding connectors can be affixed to the inner wall(s) of the housing 102 to allow such removable placement.

In accordance with the present disclosure, if one or more wetsuits are hung in the interior space of the housing 102, the wetsuits will gradually drip out any water that has accumulated within the wetsuit material, as well as create humid conditions within the interior space. The same generally applies for wet accessories. While some dripping of water is to be expected, the presently disclosed apparatus 100 is configured to quicken the drying of the wetsuit(s) by removing the water as humidity in the environment within the interior space of the housing 102.

Accordingly, in accordance with preferred implementations, the apparatus 100 includes a dehumidifier 120, that is positioned within the interior space of the housing, preferably below the racks 108 for holding the wetsuits. The dehumidifier 120 is preferably an electric dehumidifier, connected with an electrical outlet via electrical conduit 124. Depending on the cubic area of the interior space of the housing, as well as a desired dry time for drying the wetsuit(s), and even depending on the number of wetsuits being dried at the same time, the dehumidifier 120 can range from 10-70 pints dehumidification, with a 30 pint dehumidifier being a balance between energy usage and ability to dry the interior space of the housing 102.

The housing 102 includes a floor 112, which can be a set of spaced-apart slats of wood, a grate, or a similarly-porous surface. Below the floor 112 is a water catch basin 122, having a sealable outlet 126. The water catch basin 122 can receive water directly from the dehumidifier 120 as it condenses humidity from the wet wetsuit, or from each wetsuit directly as it drips water out. The dehumidifier 120 is configured to draw moisture from a proximity of each wetsuit to condense the moisture and dispense with the condensation from the interior space, i.e. sending the condensation as water to the catch basin 122, thereby providing a less humid interior area to allow each wetsuit to dry quicker and more efficiently than conventional techniques.

As the dehumidifier 120 includes a reheat coil, the dehumidifier 120 can be configured to provide an amount of heat to the environment in the interior space of the housing 102, but not too much heat that might damage the material of the wetsuit and/or accessories being dried therein. Accordingly, a dehumidifier 120 can be selected based on a variety of variables, from its moisture-absorbing volume per hour, to its heat-generation ability, to its form factor and size, or any combination thereof.

In some implementations, the dehumidifier 120 can be configurable so as to withdraw an adjustable amount of moisture from the environment of the interior of the housing 102, and by default from each wetsuit, so as to be able to accommodate any specific time frame for drying and/or any number of wetsuits or accessories. Water that accumulates within the catch basin 122 can be emptied via outlet 126, such as via a hose or other additional conduit, and which can be directed outside of a structure that contains the apparatus 100, such as a garage, a balcony or a room of a house.

In some implementations, the apparatus 100 can include a sensor 130 for sensing one or more factors of the environment of the interior space of the housing. For instance, the sensor 130 can be a humidity sensor to sense a humidity or moisture level within the interior space of the housing 102. Alternatively, the sensor 130 can be a temperature sensor to sense a temperature of the interior space of the housing 102. In yet other implementations, the sensor 130 can include multiple sensors, to include two or more of a humidity sensor, a temperature sensor, or even a pathogen sensor to sense, for example, the presence of bacteria or other pathogens that might be accumulated by the wetsuit from the ocean, for instance. In one example, the sensor 130 can be configured to detect the presence of sewage or other noxious substances in the water, so that the wearer can take remedial action to rectify the situation.

The sensor 130 can include a visual indicator, such as one or more light emitting diodes (LEDs), to indicate a state of the environment of the interior space of the housing and/or of the wetsuit(s) themselves. Further, the sensor 130 can include any number of electronics, such as a transceiver, for wirelessly transmitting an indication of the state of the wetsuit(s) and/or the environment of the interior space of the housing 102. In some implementations, not shown, the apparatus 100 can include an environmental remediation device, such as a UV light source, disinfectant supply, or the like, responsive to the sensor 130 to remedy any adverse situation with the wetsuit(s) and/or the environment of the interior space of the housing 102. The electronics can include a signal generator, a light source, a sound generator, a haptic output such as a vibration to indicate a dry state of a wetsuit, or any combination thereof.

FIGS. 2-6 illustrate specific implementations of an apparatus 200 for storing and drying one or more wetsuits. As can be seen, the apparatus 200 includes four racks 202, which are spaced apart 4 or 5", to allow at least some space between adjacent wetsuits. The dehumidifier can be installed within the interior space of a housing, and covered by a grill or other cover. In some implementations, the dehumidifier is removable and replaceable with a different dehumidifier, so as to allow a user some degree of flexibility in choosing a dehumidifier that fits their routine, schedule and/or degree of drying needed.

Although a few embodiments have been described in detail above, other modifications are possible. Other embodiments may be within the scope of the following claims.

The invention claimed is:

1. A wetsuit storage and drying apparatus comprising:
   - a housing that forms an interior space, the housing having at least one opening that is sized and adapted to receive a wetsuit into the interior space;
   - a door coupled to the housing, the door being configured to close and seal the at least one opening, the seal being a watertight seal;
   - at least one rack connected with the interior space of the housing, and shaped and configured to allow the wetsuit to be draped thereover, the at least one rack having a rounded upper edge having a diameter of at least six inches; and
   - a dehumidifier positioned in the interior space of the housing proximate the at least one rack.

2. The wetsuit storage and drying apparatus in accordance with claim 1, further comprising an electrical connection for supplying electricity to the dehumidifier.

3. The wetsuit storage and drying apparatus in accordance with claim 1, wherein the at least one rack includes one or more holes in the rounded upper edge.

4. The wetsuit storage and drying apparatus in accordance with claim 1, wherein the at least one rack includes an attachment to allow the at least one rack to be repositioned within the interior space of the housing.

5. The wetsuit storage and drying apparatus in accordance with claim 4, wherein the attachment is configured to attach the at least one rack to an inner wall of the housing.

6. The wetsuit storage and drying apparatus in accordance with claim 1, wherein the housing includes a floor, and wherein the wetsuit storage and drying apparatus further comprises a water catch basin below the floor.

7. The wetsuit storage and drying apparatus in accordance with claim 6, wherein the water catch basin includes a sealable outlet for allowing removal of water accumulated by the dehumidifier.

8. The wetsuit storage and drying apparatus in accordance with claim 1, further comprising a sensor for sensing one or more factors of the environment of the interior space of the housing.

9. A wetsuit storage and drying apparatus comprising:

a housing formed of wood, the housing forming an interior space and having at least one opening that is sized and adapted to receive a wetsuit into the interior space;

a door coupled to the housing, the door being configured to close and seal the at least one opening, the seal being a watertight seal;

at least one rack connected with the interior space of the housing, and shaped and configured to allow the wetsuit to be draped thereover, the at least one rack having a rounded upper edge having a diameter of at least six inches; and a dehumidifier positioned in the interior space of the housing proximate the at least one rack.

10. A wetsuit storage and drying apparatus comprising:

a housing that forms an interior space, the housing having at least one opening that is sized and adapted to receive a wetsuit into the interior space;

a door coupled to the housing, the door being configured to close and seal the at least one opening, the seal being a watertight seal, the door including at least one transparent window;

at least one rack connected with the interior space of the housing, and shaped and configured to allow the wetsuit to be draped thereover, the at least one rack having a rounded upper edge having a diameter of at least six inches;

a dehumidifier positioned in the interior space of the housing proximate the at least one rack; and a sensor for sensing one or more factors of the environment of the interior space of the housing.

* * * * *